US007188375B2

(12) United States Patent
Harrington

(10) Patent No.: US 7,188,375 B2
(45) Date of Patent: Mar. 13, 2007

(54) INFANT PROTECTIVE HEAD COVERING

(76) Inventor: Norman Richard Harrington, 199425 2nd Line, North East, R.R. 3, Dundalk, Ontario (CA) N0C 1B0

( * ) Notice: Subject to any disclaimer, the term of this patent is extended or adjusted under 35 U.S.C. 154(b) by 0 days.

(21) Appl. No.: 10/872,001

(22) Filed: Jun. 21, 2004

(65) Prior Publication Data

US 2005/0278832 A1 Dec. 22, 2005

(51) Int. Cl.
*A42B 3/00* (2006.01)

(52) U.S. Cl. ..... 2/411; 2/412; 2/183

(58) Field of Classification Search ..... 2/411, 2/412, 414, 171, 172, 183
See application file for complete search history.

(56) References Cited

U.S. PATENT DOCUMENTS

| | | | | |
|---|---|---|---|---|
| 3,171,133 | A * | 3/1965 | Steffen | 2/414 |
| 3,555,561 | A * | 1/1971 | Neis | 2/411 |
| 4,343,047 | A | 8/1982 | Lazowski et al. | |
| 4,665,569 | A | 5/1987 | Santini | |
| 5,481,759 | A | 1/1996 | Rinaldi | |
| 5,544,367 | A | 8/1996 | March, II | |
| 5,615,419 | A * | 4/1997 | Williams | 2/411 |
| 5,661,854 | A | 9/1997 | March, II | |
| 6,088,840 | A | 7/2000 | Im | |
| 6,421,840 | B1 * | 7/2002 | Chen et al. | 2/410 |
| 6,493,881 | B1 * | 12/2002 | Picotte | 2/413 |
| 6,546,559 | B1 | 4/2003 | Bronson | |
| 7,103,923 | B2 * | 9/2006 | Picotte | 2/412 |
| 2003/0195450 | A1 | 10/2003 | Argenta | |
| 2004/0003452 | A1 | 1/2004 | Schiebl | |
| 2004/0015118 | A1 | 1/2004 | Sklar | |
| 2004/0181860 | A1 * | 9/2004 | Forsyth-Gibson | 2/456 |

FOREIGN PATENT DOCUMENTS

| | | | |
|---|---|---|---|
| CH | 692011 | A5 * | 1/2002 |
| EP | 673610 | | 8/1999 |
| GB | 3005278 | | 7/2002 |

* cited by examiner

*Primary Examiner*—Rodney M. Lindsey
(74) *Attorney, Agent, or Firm*—Evelyn A. DeFilló; Defillo & Associates, Inc.

(57) ABSTRACT

A multi-component and multi-layer infant protective head covering including flexible layers and extensible connections.

7 Claims, 2 Drawing Sheets

INFANT PROTECTIVE HEAD COVERING

BACKGROUND

The prior art shows many different attempts to provide protection to the human head during various stages of life and various activities. Most such efforts are directed at providing a hard shell in a single or multiple components with a comfort layer between the shell and the head to provide for fit and reduction in the force of exterior impacts.

The hard shell exterior may be designed specifically for a particular sport such as horseback riding or motorcycle riding and may be a single moulded piece or a series of co-acting pieces as shown in US published pending patent application U.S. 2004/0003452 A1, U.S. Pat. No. 5,544,367 and U.S. Pat. No. 4,665,569. Efforts to make these more effective have resulted in multi-cell constructions such as shown in U.S. Pat. No. 4,343,047. In many cases these are designed to provide strong protection in high energy impact situations.

Infant appliances have followed this same structure including a hard plastic shell such as is shown in US published pending patent applications 2004/0015118 A1 and 2003/0195450. In one example shown in U.S. Pat. No. 5,615,419 to Williams a toddler helmet provides a padded brim and a stretch panel in the dome for fitment. The Williams helmet is much like a winter toque with a rolled-up edge and although it provides some protection it does not take into account the multiplicity of events to which an infant/toddler may be subjected to during this period of instability and learning.

Other efforts at infant and toddler protection have followed these examples but are excessively rigid and heavy and detract from usability.

It is an object of the invention to provide an infant or toddler head protective covering which is economical to manufacture, simple and comfortable to use, adaptable to high growth and changes in children's' sizes and which provides protection from the effects of stumbles or falls, particularly during the period when the infant is just learning to stand upright and walk.

It is a further object of the invention to provide a moderate level of protection over the bulk of the infant skull in an expansible construction which provides a base for additional protective layers or areas in specific locations where stumble or fall impacts are most common.

It is a further object of the invention to provide an infant head covering which may be manufactured in components of varying sizes and readily assembled as by stitching.

It is a further object of the invention to provide an infant head covering specifically to provide protection from low energy impacts typical of the learning to walk stage of growth.

SUMMARY OF THE INVENTION

The invention provides an infant protective head covering including an ear component, a lateral component adapted to extend from the rear of the infant head above the said ear component and across the upper forehead, a forehead component adapted to extend between each ear component across the infant forehead, an upper component adapted to extend from said forehead component to the rear of the infant head between said lateral components, wherein each said component is comprises of a flexible and extensible material, and flexible and extensible connection means extend between said components.

The invention also provides an infant head covering wherein each said component further includes flexible and extensible protective interior and/or outer layers. The exterior layer may extend over on portions of the interior layer for maximum protection and comfort with minimal materials and costs. The components are connected by extensible stitching and may be covered with a containment exterior layer or skin adapted for decorative purposes.

THE DRAWINGS

THE PRFERRED EMBODIMENT AND DETAILED DESCRIPTION OF THE INVENTION

Figure 1:
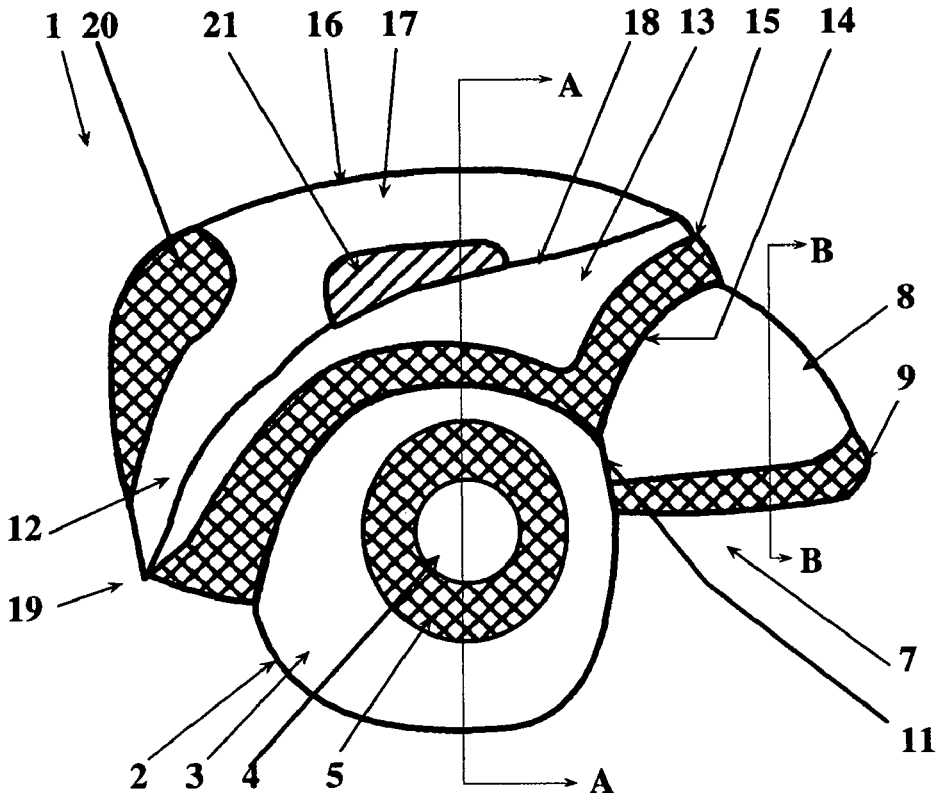
FIG. 1 is a side elevation of the baby hat pad of the invention.

The baby hat pad of the invention 1 is generally depicted in side elevation in FIG. 1 is preferably a 3 layer and multi-part construction. The hat 1 is generally shaped to fit securely over the head of an infant. Interior layers are preferably formed from sheet material which is both flexible and somewhat extensible such as foam plastic or rubber. Additional layers are preferably formed of similar material while outer layers are preferably formed of extensible fabric-like material and enclose the interior layers. Each component is flexibly attached as by stitching.

Figure 2:
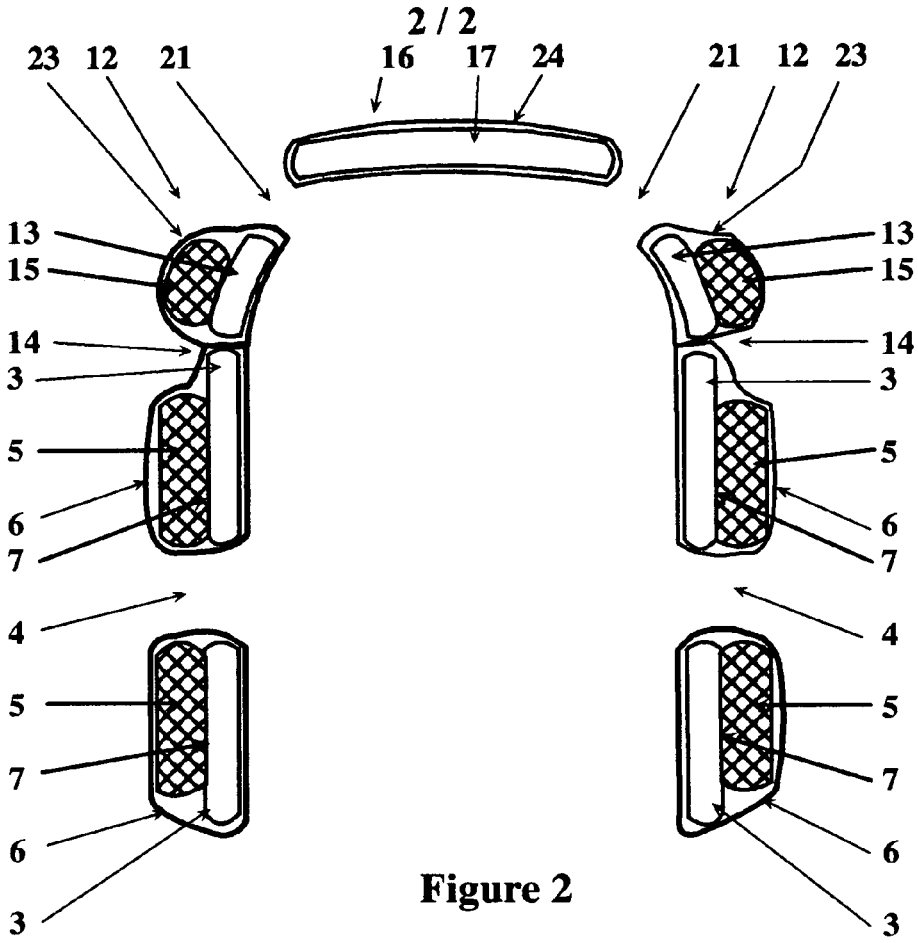
FIG. 2 is a cross-section of the hat of FIG. 1 taken along line A—A.

Ear protection component 2 comprises an interior single layer of cushion material 3 with an opening as at 4 for hearing. An additional ear component layer of cushioning material 5 surrounds opening 4. As can be seen in the cross-section of FIG. 2 the ear component 2 is enclosed in a stretchable fabric-like layer 6 which assists in retaining layers 3 and 5 in juxtaposition to ear opening 4. Additionally, layers 3 and 5 may be bonded together as at 7 for extra retention by a flexible cement (not shown).

Figure 3:
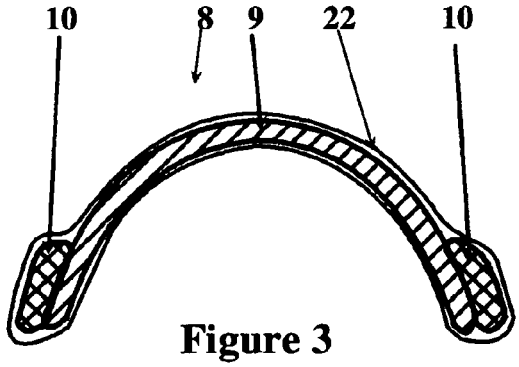
FIG. 3 is a further cross-section of the hat of FIG. 1 taken along line B—B.

Forehead protection component 8 as shown in FIG. 3 includes an interior single layer of cushion material 9 and an additional forehead cushion layer 10 along its lower extremity. Forehead component 8 is enclosed in stretchable fabric as at 22. Forehead component is preferably attached to ear component 3 by flexible and extensible stitching along stitch line 11 in FIG. 1.

Lateral protection component 12 includes an interior single layer of cushion material 13 and is flexibly and extensibly attached to ear component 3 and forehead component 8 along stitch line 14 so as to extend laterally along the infant's head above the ear and across the top of the forehead. Lateral component 12 includes an additional lateral cushion layer 15 extending from the rear of the infant's head laterally above the ear and then across the top of the forehead adjacent stitch line 14. Lateral component 12 is enclosed in stretchable fabric as at 23 in FIG. 2.

Upper component 16 includes an interior single layer of cushion material 17 and is flexibly and extensibly attached to lateral component 13 along stitch line 18 so as to cover the infant head and extend rearwardly to the base of the skull as at 19 in FIG. 1. Upper component 19 includes an additional upper cushion layer 20 at the rear of the infant skull as is enclosed in stretchable fabric as at 24 in FIG. 2.

Preferably hat 1 will include ventilation holes as at 21 in FIG. 1 along stitch line 18 to ease construction and provide a better fit over a variety of infant head sizes and with a variety of infant activities.

While the preferred embodiments of the method and apparatus of the invention have been described variations in the design may be made by persons skilled in the art.

What I claim is:

1. Infant protective head covering comprising:

a) an ear component, b) a lateral component adapted to extend from the rear of the infant head above the said ear component and across the upper forehead, c) a forehead component adapted to extend between each ear component across the infant forehead, d) an upper component adapted to extend from said forehead component to the rear of the infant head between said lateral component, e) wherein each said component is comprises of a flexible and extensible material, and f) flexible and extensible connection means between said components.

2. An infant head covering as claimed in claim 1 wherein each said component further comprises a flexible and extensible protective interior layer.

3. An infant head covering as claimed in claim 2 wherein said components further comprise an exterior flexible and extensible protective layer.

4. An infant head covering as claimed in claim 3 wherein said exterior layer extends over limited areas of said interior layer.

5. An infant head covering as claimed in claim 4 wherein said connection means comprises extensible stitching.

6. An infant head covering as claimed in claim 5 wherein said components are enveloped in a fabric like external layer and connection along their lateral edges.

7. An infant head covering as claimed in claim 6 further comprising a ventilation space between said lateral and said upper components above said ear component.

* * * * *